US006805936B2

(12) United States Patent
Seaton

(10) Patent No.: US 6,805,936 B2
(45) Date of Patent: Oct. 19, 2004

(54) SPORTS PLAYING SURFACES FOR REALISTIC GAME PLAY

(76) Inventor: Reed Seaton, 11009 Pencewood Ct., Austin, TX (US) 78641

( * ) Notice: Subject to any disclaimer, the term of this patent is extended or adjusted under 35 U.S.C. 154(b) by 0 days.

(21) Appl. No.: 10/287,764

(22) Filed: Nov. 4, 2002

(65) Prior Publication Data

US 2004/0086664 A1 May 6, 2004

(51) Int. Cl.[7] ..... B32R 33/00

(52) U.S. Cl. ..... 428/87; 428/17; 428/85; 405/302.7; 47/58.1 R

(58) Field of Search ..... 428/15, 17, 85, 428/87; 405/36, 302.7, 303; 47/58.1 R, 65.5, 56, 101 R

(56) References Cited

U.S. PATENT DOCUMENTS 3,995,079 A 11/1976 Haas, Jr.
4,337,283 A 6/1982 Haas, Jr.
4,389,435 A 6/1983 Haas, Jr.
4,396,653 A 8/1983 Tomarin
4,610,568 A * 9/1986 Koerner
5,041,320 A 8/1991 Meredith et al.
6,216,389 B1 * 4/2001 Motz et al.
6,295,756 B1 * 10/2001 Bergevin
6,299,959 B1 10/2001 Squires et al.

* cited by examiner

*Primary Examiner*—Deborah Jones
*Assistant Examiner*—Wendy Boss
(74) *Attorney, Agent, or Firm*—Adams and Reese LLP

(57) ABSTRACT

A filled synthetic sports playing surface is provided comprising, generally, a synthetic grass having fibers secured to a backing fabric. The backing fabric may have single, composite or multiple layers. The fibers can be formed from polyolefins, their co-polymers, or polyamides, and may be monofilament or slit film type yarns. The top dressing comprises natural soil or a synthetic soil or may be a mix of natural soil or synthetic soil with conventional infill material, such as resilient particles, mineral particles coated with a resilient layer or other types of infill materials. Alternatively, the top dressing may include an absorbent material treated with a coloring agent. The filled fabric generally described above may be installed over a drainage system and can have an irrigation system, particularly for an indoor field, in order to simulate wet weather conditions, provide for more realistic game play and manage other aspects of the field.

47 Claims, 3 Drawing Sheets

SPORTS PLAYING SURFACES FOR REALISTIC GAME PLAY

STATEMENT REGARDING FEDERALLY SPONSORED RESEARCH OR DEVELOPMENT

Not applicable

FIELD OF THE INVENTION

The present invention relates to an improved synthetic surface for sports and other uses that replicates the appearance and playing conditions of natural grass, and particularly to simulate wet weather conditions and more realistic game play.

BACKGROUND OF THE INVENTION

For years natural turf surfaces were used for most outdoor sports. However, natural turf (grass) surfaces do not stand up well to heavy use and poor weather conditions. Under these conditions, natural turf surfaces deteriorate rapidly and may present unsafe playing conditions. The natural grass and its root system is destroyed, leaving only bare earth as the playing surface. Additionally, natural turf surfaces do not grow well in areas that are routinely exposed to low ambient temperatures, or on fields that are used extensively or for multiple sports, as well as in partly of fully enclosed sports stadiums.

Synthetic surfaces have been used as an alternative to natural turf surfaces to overcome its disadvantages. Synthetic grass surfaces require less maintenance and can withstand a more intensive use than natural turf. Synthetic turf can be categorized into two generalized divisions, conventional turf and filled turf. Conventional synthetic turf is a dense synthetic material that has the appearance of dense grass blades, which is placed upon a foundation of asphalt, concrete, wood, or other foundation. Conventional turf provides a synthetic playing surface that closely simulates the appearance and physical characteristics of natural turf, however, there is a significant expense associated with preparing and installing an appropriate cushioning and drainage system. In order to achieve a highly durable, less expensive alterative to conventional turf, there have been numerous attempts to use top dressings or fillings between the synthetic grass blades. Filled synthetic turf is installed upon similar foundations and utilizes materials similar to conventional turf, but with greater spacing between the synthetic grass blades to accommodate the top dressing.

Filled turf surfaces have been top-dressed with sand, as shown by way of example in U.S. Pat. No. 3,995,079, and U.S. Pat. No. 4,389,435, or a mixture of sand and other particulate materials, as shown by way of example in U.S. Pat. No. 4,337,283, U.S. Pat. No. 4,396,653 and resilient particles without sand, as shown by way of example in U.S. Pat. No. 5,041,320. The particulate material provides resiliency to the synthetic surface. U.S. Pat. No. 6,299,959, which is herein incorporated by reference, discloses a particularly useful filled turf surface comprising a "thatch zone" layer of tufted nylon 6.6 that locks the resilient particles inside the "thatch zone."

Filled turf surfaces have several disadvantages. Filled turf surfaces that utilize sand or a mixture of a significant amount of sand and other particulate material exhibit the tendency to compact over time. With an increase in compaction, the surface becomes progressively harder and less resilient. Replacing, or even loosening the compacted material can be expensive and adds to the costs of maintaining the surface. Compaction also inhibits drainage of water from the surface.

Other aspects of game play are also affected when filled turf surfaces are utilized. The level of resiliency and compaction can affect the way a ball responds to the surface, as well as the increase in traction of the game players footing. Additionally, the elements of wet weather game play, such as the reality of soiled clothing and the changes in game play associated with wet weather conditions, are not present, particularly in indoor installations.

SUMMARY OF THE INVENTION

In order to improve conventional synthetic sports playing surfaces and provide more realistic game play, a synthetic sports playing surface is provided comprising, generally, a synthetic grass having grass-like fibers secured to a backing fabric. The backing fabric may be a single layer or multiple layers. Further, the backing fabric may be constructed as a laminate of woven and non-woven layers, multiple woven layers or multiple non-woven layers. Preferably, the backing fabric is a laminate of a woven fabric component and a fiberglass reinforcing matrix. Most preferably, the backing fabric comprises a fiberglass reinforcing matrix integrated with a woven fabric component, such as the composite fabric disclosed in pending patent application Serial No. (not yet assigned), filed Oct. 16, 2002, which said disclosure is herein incorporated by reference. The grass-like fibers can be formed of any polyolefin or their co-polymers, but are preferably polyethylene co-polymer because it is less abrasive. The grass-like fibers may be constructed as a monofilament yarn or may be constructed as a slit film type yarn. The tips of the grass-like fibers can be mechanically fibrillated either during of subsequent to installation of the top dressing to give the grass-like surface a denser appearance and to help contain the top dressing. The grass-like fibers can be secured to the backing by numerous means including knitting or weaving, however, tufting is the preferred means. After securing the grass-like fibers to the backing fabric, the backing fabric is sprayed with a resilient latex type or other carpet adhesive to lock in the secured fibers. The top dressing comprises natural soil or a synthetic soil or may be a mix of natural soil or synthetic soil with conventional infill material, such as resilient particles, mineral particles coated with a resilient layer or other types of infill materials. The filled fabric generally described above may be installed over a drainage system and can have an irrigation system, particularly for an indoor field, in order to simulate wet weather conditions, provide for more realistic game play and manage other aspects of the field.

PREFERRED EMBODIMENTS OF THE INVENTION

In the following detailed description of the preferred embodiments, reference is made to the accompanying drawings, which form a part hereof, and in which are shown by way of illustration specific embodiments in which the invention may be practiced. It is to be understood that other embodiments may be utilized and structural changes may be made without departing from the scope of the present invention.

Figure 1:
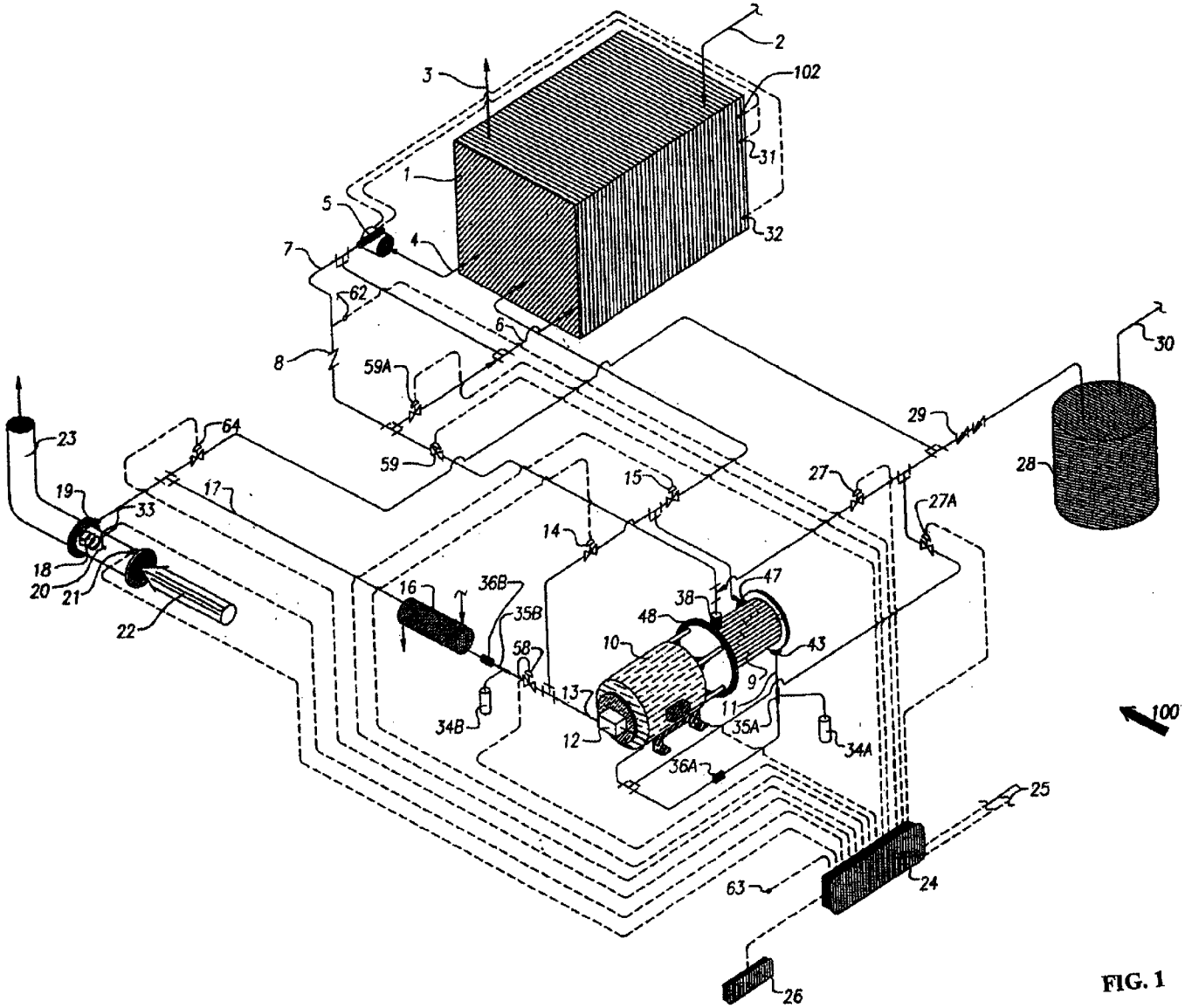
FIG. 1 is a side elevation illustrating one preferred embodiment of a filled synthetic turf according to the present invention.

FIG. 1 shows a side elevation of one preferred embodiment of a filled synthetic turf 10 according to the present invention and its constituent components. The grass-like surface forming fibers 20 are tufted through the composite backing sheet composed of a non-woven component 31 and woven component 30. The non-woven component 31 is preferably a reinforcing fiberglass matrix superimposed upon a carrier fabric of polyester. The woven component 30 is preferably a woven polypropylene fabric. After tufting the grass-like surface forming fibers 20 through the composite backing 30, 31, the fibers 20 are secured to the composite backing 30, 31 by applying a coating of flexible adhesive material to the underside of the composite backing 30, 31.

Figure 2:
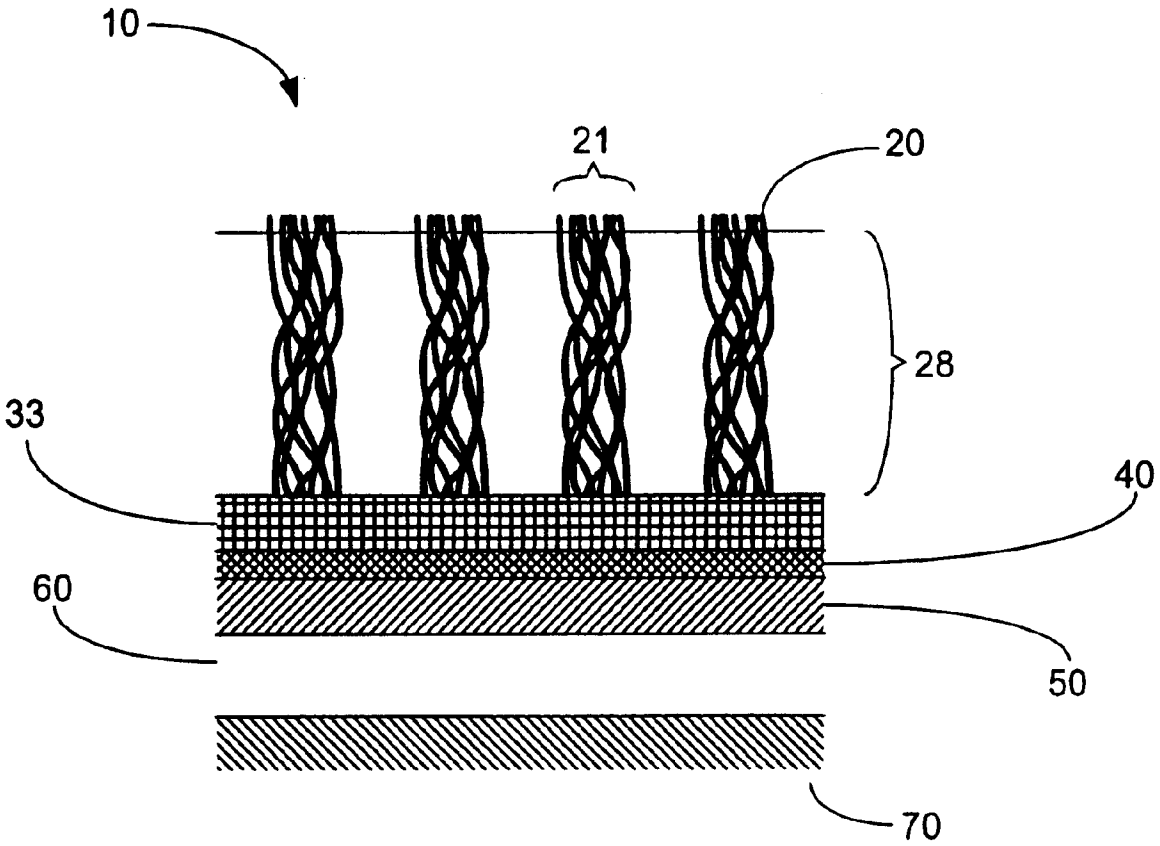
FIG. 2 is a side elevation illustrating another preferred embodiment of a filled synthetic turf according to the present invention.

FIG. 2 shows a side elevation of one preferred embodiment of a filled synthetic turf 10 according to the present invention and its constituent components. The grass-like surface forming fibers 20 are tufted through the composite backing 33 constructed in accordance with pending patent application Serial No. (not yet assigned), filed Oct. 16, 2002. Generally, the composite backing may be constructed by simultaneously feeding a woven fabric and a fiberglass reinforcing scrim through a needlepunch machine. As the needles of the needlepunch machine penetrate the two contiguous components, the warp and weft yarns of the woven fabric are fibrillated, creating a fibrous batt on both sides of the woven fabric. Concurrent with the creation of the fibrous batt, the needles interlock the reinforcing scrim within the individual fibers of the fibrous batt. Alternatively, the fiberglass strands of the reinforcing scrim may be incorporated into the woven fabric during its construction.

After the manufacturing of the synthetic turf fabric 10, it maybe glued to or loosely laid upon a resilient pad 50. If employed, the resilient pad is preferably an elastomeric pad, for example, E-Layer® Shock pad. The pad is preferably about 1.5 mm to about 20 mm thick. The resilience from the pad 50 provides safer shock absorption levels. FIGS. 1 and 2 show preferred embodiments that utilize a geotextile membrane 40 between the composite backing 30, 31 and the resilient pad 50 for improved drainage efficiency.

FIGS. 1 and 2 also show the subsurface foundation upon which the filled synthetic turf 10 is installed. The sub-grade 70 provides a structural base and is formed of earth and rock existing on the site. A sub-base 60 may be formed upon the sub-grade 70 to provide sufficient drainage of water. The sub-base 60 may be constructed of any combination of materials including sand, rubber, rock, and other organic or inorganic material. The preferred construction of sub-base 60 comprises a porous layer of crushed stone. Conventional piping systems (not shown) may be placed in or on the sub-grade 70 or in the sub-base 60 to provide irrigation and drainage. An irrigation and drainage network for natural turf systems along with a flow control scheme is disclosed in U.S. Pat. No. 5,944,444. A similar network and flow control scheme can be used with the filled synthetic turf of the present invention to simulate wet weather game play. Sprinkler systems could also be employed with the drainage system installed below grade.

As seen in FIGS. 1 and 2, grass-like fibers 20 are supported by the top dressing or infill 28. The top dressing 28 may comprise natural soil or a synthetic soil and preferably comprises a mix of natural soil or synthetic soil with conventional infill material, such as resilient particles, mineral particles coated with a resilient layer or other types of infill materials. Synthetic soil, such as disclosed in U.S. Pat. No. 4,826,350, which is incorporated herein by reference, may comprise natural soil constituents, fine sand for regulating particle size, synthetic resin emulsions for regulating compression strength and soil agglomerating agents for regulating the bending strength of the synthetic soil surface. By regulating particle size, the fine sand constituent of the synthetic soil optimizes the compacted moisture content. The preferred amount of fine sand in the blend is about 0 to 25% by weight. The synthetic resin emulsion, such as ethylene vinyl acetate, acryl and vinyl acetate emulsions, optimizes compression strength of the blend and ensures water permeability of the compacted synthetic soil is maintained. The preferred amount of synthetic resin emulsion is about 0 to 20 kilograms per cubic meter of synthetic soil. Soil agglomerating agents, such as polyethylene oxide, polyacrylamide, polyolefin and polyvinyl acetate, heighten the bending strength of the synthetic soil surface. The preferred amount of agglomerating agent is about 0 to 2 liters per cubic meter of synthetic soil. The addition of natural soil or synthetic soil to the infill 28 returns to the games played on synthetic sports surfaces the reality of playing in wet weather conditions. Rain water falling on outdoor installations and irrigation from an irrigation system associated with indoor installations will muddy the field providing more realistic game play.

Alternatively, the top dressing 28 may comprise conventional infill material mixed with a carrier material treated with a water-soluble coloring agent. The carrier material should be capable of absorbing moisture. The coloring agent can be applied to the infill via the irrigation system. Once the filled synthetic turf system is saturated with water containing the coloring agent, the wet surface will simulate a muddy surface including temporarily staining the athlete's clothing.

Figure 3:
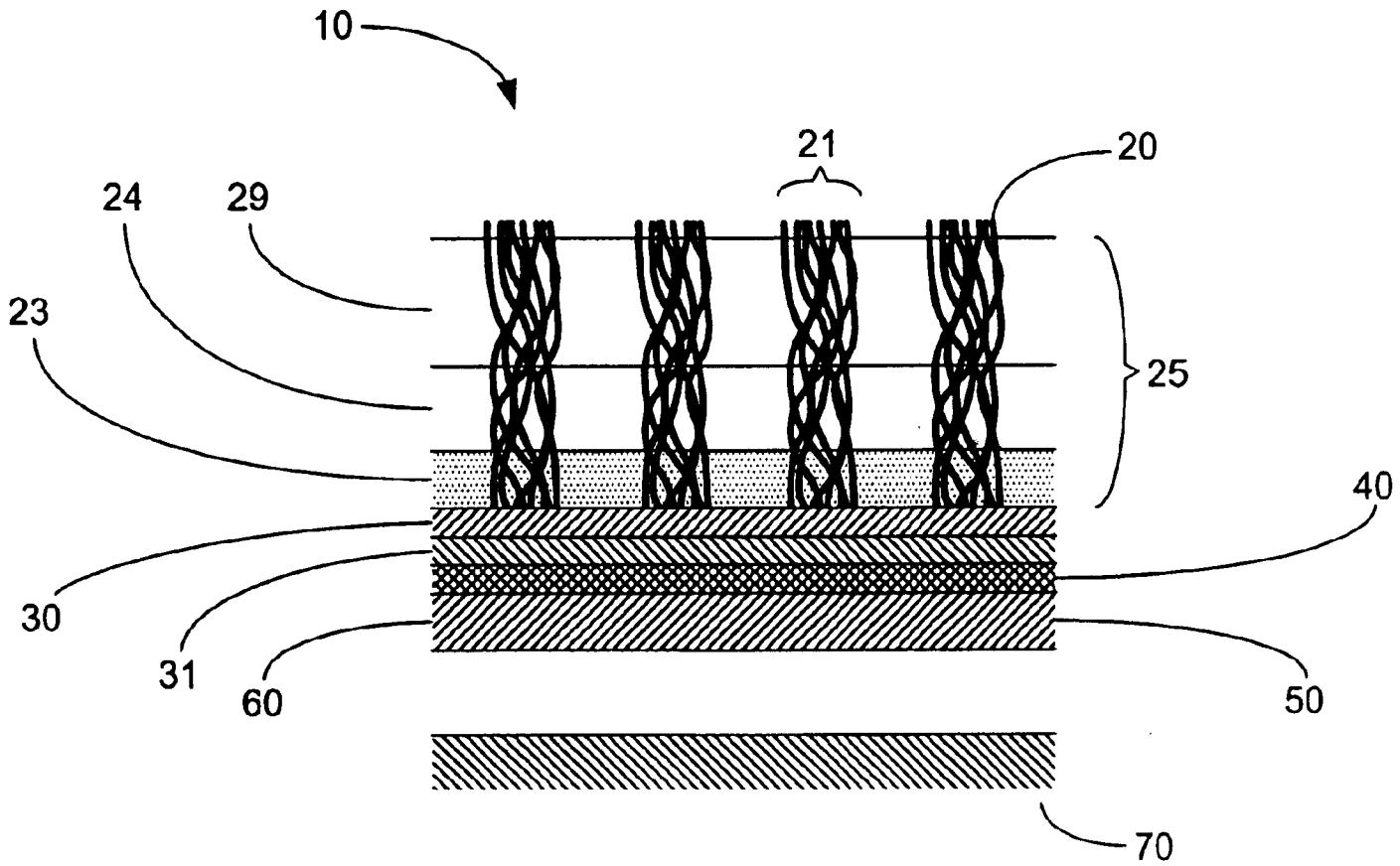
FIG. 3 is a side elevation illustrating a preferred embodiment of filled synthetic turf according to the present invention.
Figure 1:
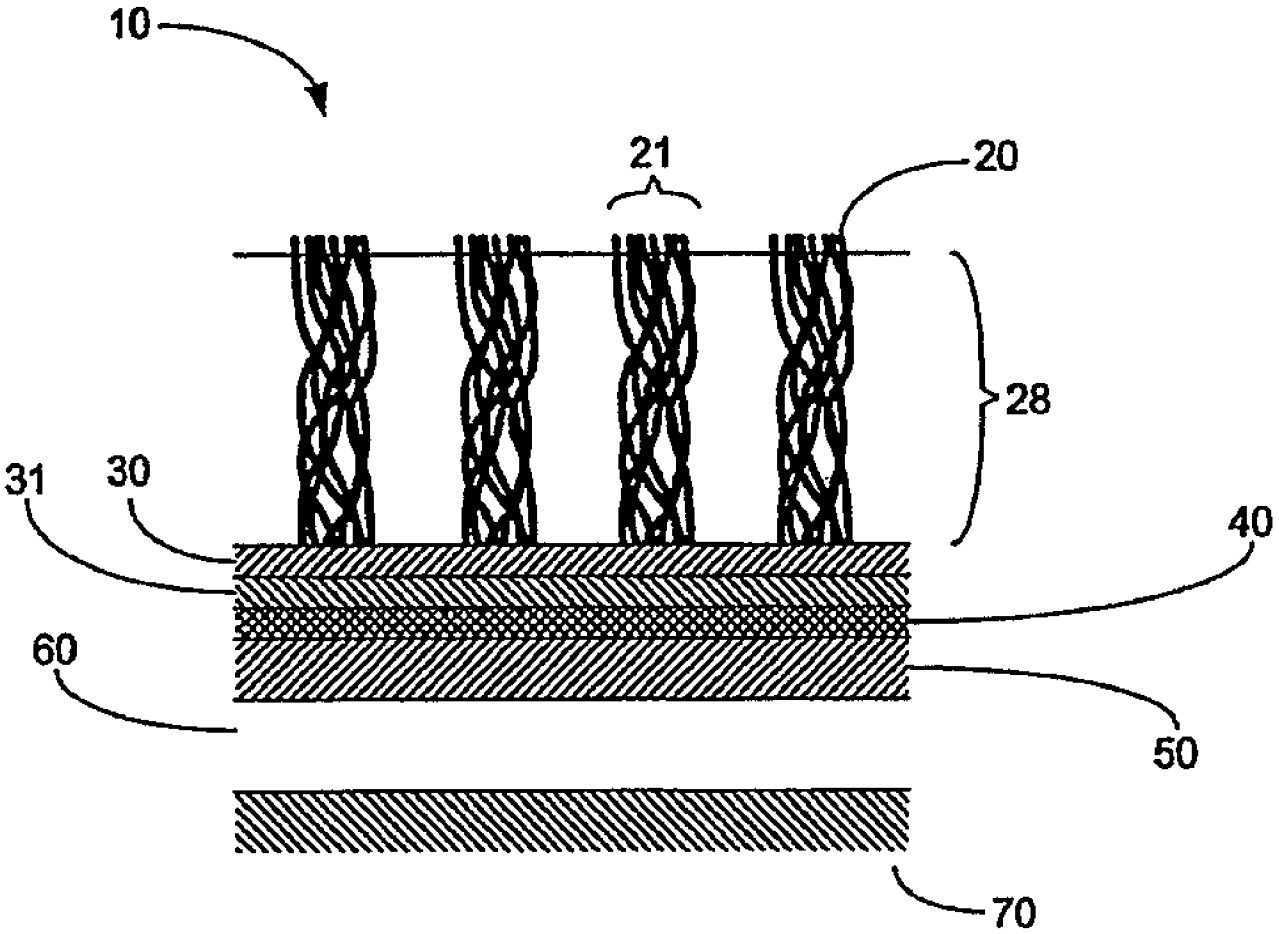

FIG. 3 shows a preferred embodiment of the filled synthetic turf 10. The preferred embodiment includes a layer of thatch-like texturized nylon 6.6 fibers 23 which are tufted through the composite backing 30, 31 along with the grass-like surface forming fibers 20. The grass-like fibers 20 may range from about 1 to six inches in height, but preferably have about two to three inch pile height and are made of polypropylene or polyethylene co-polymer. The grass like fibers 20 may be constructed as a monofilament yarn or as a slit film yarn. The grass like fibers 20 preferably has a denier between about 6,000 to about 15,000 for monofilament yarn and a denier between about 7600 to about 8000 for slit film yarn. The grass-like fibers 20 may also be fibrillated in order to provide a denser appearance and provide containment for the top dressing. The thatch-like fibers 23 are preferably a bundle of at least four strands of texturized nylon 6.6 monofilament ribbon with a denier of between about 350 and 800 and tufted to about a two inch pile height. After tufting, the resulting pile fabric is cut and oven cured. Curing causes the texturized thatch-like fibers 23 to crinkle severely and contract to an overall pile height of about one inch.

FIG. 3 also shows a preferred embodiment of a layered infill 25. The bottom layer 24 is comprised substantially of resilient particles. The thatch-like fibers 23 lock in the resilient particles and reduce the migration rate of resilient particles into the upper layer or layers of the top dressing. The bottom layer 24 of resilient particles may exceed the pile height of the thatch-like fibers 23, as shown in FIG. 3, equal the pile height of the thatch-like fibers 23, or may have a thickness less than the pile height of the thatch-like fibers 23. The top layer 29 may comprise natural soil or a synthetic soil and preferably comprises a mix of natural soil or synthetic soil with conventional infill material, such as resilient particles, mineral particles coated with a resilient layer or other types of infill materials.

Although the present invention has been described in terms of specific embodiments, it is anticipated that alterations and modifications thereof will no doubt become apparent to those skilled in the art. It is therefore intended that the following claims be interpreted as covering all alterations and modifications that fall within the true spirit and scope of the invention.

What is claimed is:

1. A filled synthetic sports surface comprising: a sub-grade foundation; an aggregate sub-base over said sub-grade foundation; a resilient pad over said aggregate sub-base; geotextile membrane over said resilient pad; and a synthetic turf over said geotextile membrane, said synthetic turf comprising a baCking fabric, substantially upstanding synthetic grass-like fibers forming a playing surface and tufted into said backing fabric, the length of said synthetic grass-like fibers being substantially uniform, and a top dressing interspersed among said synthetic grass-like fibers and on said banking fabric to a substantially uniform depth, said top dressing comprising natural soil.

2. The filled synthetic sports surface of claim 1, wherein said resilient pad is an elastomeric pad having a thickness between about 1.5 millimeters to about 20 millimeters.

3. The filled synthetic sports surface of claim 1, wherein said synthetic grass-like fibers range from about 1 to about 6 inches in height.

4. The filled synthetic sports surface of claim 1, wherein said synthetic grass-like fibers comprise polypropylene monofilament yarn having a denier between about 6,000 to about 15,000.

5. The filled synthetic sports surface of claim 1, wherein said synthetic grass-like fibers comprise polypropylene slit film yarn having a denier between about 7,600 to about 8,000.

6. The filled synthetic sports surface of claim 1, wherein said backing fabric comprises a woven component having warp yarns and waft yarns, a reinforcing component on said woven component, said reinforcing component comprising an array of reinforcement strands laid in an open network structure, said woven component and said reinforcing component fibrillated together to thereby form a fibrous batt, said fibrous batt maintaining said woven component and said reinforcing component as an integrated fabric.

7. The filled synthetic sports surface of claim 6, wherein said warp yarns and said weft yarns of said woven component are manufactured of polypropylene.

8. The filled synthetic sports surface of claim 6, wherein said reinforcing component comprises an array or glass strands laid in an open network structure and said glass strands extend in at least two different directions.

9. The filled synthetic sports surface of claim 1, wherein said backing fabric comprises warp yarns, weft yarns, and a plurality of interlaced reinforcement strands extending in at least one direction.

10. The filled synthetic sports surface of claim 1, wherein said top dressing further comprises about 5% to about 95% resilient particles interspersed within said natural soil.

11. The filled synthetic sports surface of claim 1, wherein said top dressing further comprises a mixture of natural soil, sand ranging from about 0 to about 25% by weight of said mixture, synthetic resin emulsion ranging from about 0 to about 20 kilograms per cubic meter of said mixture and a soil agglomerating agent ranging from about 0 to about 2 liters per cubic meter of said mixture.

12. The filled synthetic sports surface of claim 11, wherein said top dressing further comprises about 5% to about 95% resilient particles interspersed within said mixture.

13. The filled synthetic sports surface of claim 1, farther comprising a network of pipe located below said synthetic turf for irrigating and draining said sports surface.

14. A filled synthetic sports surface comprising: a sub-grade foundation; an aggregate sub-base over said sub-grade foundation; a resilient pad over said aggregate sub-base; a geotextile membrane over said resilient pad; and a synthetic turf over said geotextile membrane, said synthetic turf comprising a backing fabric, substantially upstanding synthetic grass-like fibers forming a playing surface and tufted into said backing fabric, the length of said synthetic grass-like fibers being substantially uniform, thatch-like fibers tufted into said composite backing and interspersed among said synthetic grass-like fibers, and a top dressing interspersed among said synthetic grass-like fibers and said thatch-like fibers and on said backing fabric to a substantially uniform depth, said top dressing comprising natural soil.

15. The filled synthetic sports surface of claim 14, wherein said resilient pad is an elastomeric pad having a thickness between about 1.5 millimeters to about 20 millimeters.

16. The filled synthetic sports surface of claim 14, wherein said synthetic grass-like fibers range from about 1 to about 6 inches in height.

17. The filled synthetic sports surface of claim 14, wherein said synthetic grass-like fibers comprise polypropylene monofilament yarn having a denier between out 6,000 to about 15,000.

18. The filled synthetic sports surface of claim 14, wherein said synthetic grass-like fibers comprise polypropylene slit film yarn having a denier between about 7,600 to about 8,000.

19. The filled synthetic sports surface of claim 14, wherein said thatch-like fibers comprise a plurality of texturized monofilament yarns bundled together, each of said yarns having a denier of about 350 about 800.

20. The filled synthetic sports surface of claim 19, wherein said texturized monofilament yarns are constructed of nylon 6.6.

21. The filled synthetic sports surface of claim 14, wherein said thatch-like fibers are about 2 inches in height.

22. The filled synthetic sports surface of claim 14, further comprising a network of pipe located below said synthetic turf for irrigating and draining said wits surface.

23. The filled synthetic sports surface of claim 14, wherein said backing fabric comprises a woven component having warp yarns and weft yarns, a reinforcing component on said woven component, said reinforcing component comprising an array of reinforcement strands laid in an open network structure, said woven component and said reinforcing component fibrillated together to thereby form a fibrous batt, said fibrous batt maintaining said woven component and said reinforcing component as an integrated fabric.

24. The filled synthetic sports surface of claim 23, wherein said warp yarns and said weft yarns of said woven component are manufactured of polypropylene.

25. The filled synthetic sports surface of claim 23, wherein said reinforcing component comprises an array of glass strands laid in an open network structure and said glass strands extend in at least two different directions.

26. The filled synthetic sports surface of claim 14, wherein said backing fabric comprises warp yarns, weft yarns, and a plurality of interlaced reinforcement strands extending in at least one direction.

27. The filled synthetic sports surface of claim 14, wherein said top dressing further comprises a mixture of natural soil, sand ranging from about 0 to about 25% by weight of said mixture, synthetic resin emulsion ranging from about 0 to about 20 kilograms per cubic meter of said mixture, and a soil agglomerating agent ranging from about 0 to about 2 liters per cubic meter of said mixture.

28. The filled synthetic sports surface of claim 22, wherein said top dressing further comprises about 5% to about 95% resilient particles interspersed within said mixture.

29. The filled synthetic sports surface of claim 14, wherein said top dressing further comprises a first layer comprising at least about 70% resilient particles and interspersed among said synthetic grass-like fibers and said thatch-like fibers and on said backing fabric to a substantially uniform depth of about 1¼ inches to about 3½ inches, and a second layer comprising a mixture of resilient particles mixed with about 5 to about 95% natural soil.

30. A filled synthetic sports surface comprising: a sub-grade foundation; an aggregate sub-base over said sub-grade foundation; and a synthetic turf over said aggregate sub-base, said synthetic turf comprising a backing fabric, substantially upstanding grass-like fibers tufted into said backing fabric, the length of said grass-like fibers being substantially uniform, a top dressing interspersed among said grass-like fibers and on said backing fabric to a substantially uniform depth, said top dressing comprising art absorbent material saturated with a water-soluble coloring agent; and a network of pipe located below said synthetic turf for irrigating and draining said sports surface.

31. The filled synthetic sports surface of claim 30, further comprising a geotextile membrane disposed between said aggregate sub-base and said synthetic turf.

32. The filled synthetic sports surface of claim 30, further comprising a resilient pad disposed between said aggregate sub-base and said synthetic turf.

33. The filled synthetic spoils surface of claim 32, further comprising a geotextile membrane disposed between said resilient pad and said synthetic turf.

34. The filled synthetic sports surface of claim 32, wherein said resilient pad is an elastomeric pad having a thickness between about 1.5 millimeters to about 20 millimeters.

35. The filled synthetic sports surface of claim 33, said resilient pad is an elastomeric pad having a thickness between about 1.5 millimeters to about 20 millimeters.

36. The filled synthetic sports surface of claim 30, wherein said grass-like fibers range from about 1 to about 6 inches in height.

37. The flied synthetic sports surface of claim 30, wherein said grass-like fibers comprise polypropylene monofilament yarn having a denier between about 6,000 to about 15,000.

38. The filled synthetic sports surface of claim 30, wherein said grass-like fibers comprise polypropylene slit film yarn having a denier between about 7,600 to about 8,000.

39. The filled synthetic sports surface of claim 30, wherein said backing fabric comprises a woven component having warp yarns and weft yarns, a reinforcing component on said woven component, said reinforcing component comprising an array of reinforcement strands laid in an open network structure, said woven component and said reinforcing component fibrillated together to thereby form a fibrous ban, said fibrous batt maintaining said woven component and said reinforcing component as an integrated fabric.

40. The filled synthetic sports surface of claim 39, wherein said warp yarns and said weft yarns of said woven component are manufactured of polypropylene.

41. The filled synthetic sports surface of claim 39, wherein said reinforcing component comprises air array of glass strands laid in an open network structure and said glass strands extend in at least two different directions.

42. The filled synthetic sports surface of claim 30, wherein said backing fabric comprises warp yarns, weft yarns, and a plurality of interlaced reinforcement strands extending in at least one direction.

43. The filled synthetic sports surface of claim 30, further comprising thatch-like fibers tufted into said composite backing and interspersed among said grass-like fibers.

44. The filled synthetic sports surface of claim 43, wherein said thatch-like fibers comprise a plurality of texturized monofilament yarns bundled together, each of said yarns having a denier of about 350 to about 800.

45. The filled synthetic sports surface of claim 44, wherein said texturized monofilament yarns are constructed of nylon 6.6.

46. The filled synthetic sports surface of claim 43, wherein said thatch-like fibers are about 2 inches in height.

47. A method of providing realistic wet weather game play on a filled synthetic sports surface comprising the steps of: providing a sub-grade foundation; applying an aggregate sub-base over said sub-grade foundation; applying a synthetic turf over said aggregate sub-base, said synthetic turf comprising a backing fabric, substantially upstanding grass-like fibers tufted into said backing fabric, the length of said grass-like fibers being substantially uniform, a top dressing interspersed among said grass-like fibers and on said backing fabric to a substantially uniform depth, said top dressing comprising an absorbent material saturated with a water-soluble coloring agent; installing a network of pipe located below said synthetic turf for irrigating and draining said synthetic sports surface; saturating said synthetic spoils surface with water before game play via said network of pipe thereby releasing said water-soluble coloring agent from said absorbent material; and saturating said synthetic sports surface with a water soluble coloring agent after game play via said network of pipe thereby replenishing said absorbent material with said water-soluble coloring agent.

* * * * *

UNITED STATES PATENT AND TRADEMARK OFFICE

CERTIFICATE OF CORRECTION

PATENT NO. : 6,805,936 B2
APPLICATION NO. : 10/287764
DATED : October 19, 2004
INVENTOR(S) : Reed Seaton It is certified that error appears in the above-identified patent and that said Letters Patent is hereby corrected as shown below:

TITLE PAGE

The title page, showing an illustrative figure, should be deleted and substitute therefor the attached title page.

Delete drawing sheet 1 of 3, and substitute therefor the attached drawing sheet 1 containing figure 1.

Signed and Sealed this

Eighteenth Day of September, 2007

JON W. DUDAS
*Director of the United States Patent and Trademark Office*

(12) United States Patent
Seaton

(10) Patent No.: US 6,805,936 B2
(45) Date of Patent: Oct. 19, 2004

(54) SPORTS PLAYING SURFACES FOR REALISTIC GAME PLAY

(76) Inventor: Reed Seaton, 11009 Peacewood Ct., Austin, TX (US) 78641

( * ) Notice: Subject to any disclaimer, the term of this patent is extended or adjusted under 35 U.S.C. 154(b) by 0 days.

(21) Appl. No.: 10/287,764

(22) Filed: Nov. 4, 2002

(65) Prior Publication Data

US 2004/0086664 A1 May 6, 2004

(51) Int. Cl.[7] ..... B32B 33/00

(52) U.S. Cl. ..... 428/87; 428/17; 428/85; 405/302.7; 47/58.1 R

(58) Field of Search ..... 428/15, 17, 85, 428/87; 405/36, 302.7, 303; 47/58.1 R, 65.5, 56, 101 R

(56) References Cited

U.S. PATENT DOCUMENTS 3,995,079 A 11/1976 Haas, Jr.
4,337,283 A 6/1982 Haas, Jr.
4,389,435 A 6/1983 Haas, Jr.
4,396,653 A 8/1983 Tomaris
4,610,568 A * 9/1986 Koerner
5,041,320 A 8/1991 Meredith et al.
6,216,389 B1 * 4/2001 Mota et al.
6,295,756 B1 * 10/2001 Bergevin
6,299,959 B1 10/2001 Squires et al.

* cited by examiner

*Primary Examiner*—Deborah Jones
*Assistant Examiner*—Wendy Boss
(74) *Attorney, Agent, or Firm*—Adams and Reese LLP

(57) ABSTRACT

A filled synthetic sports playing surface is provided comprising, generally, a synthetic grass having fibers secured to a backing fabric. The backing fabric may have single, composite or multiple layers. The fibers can be formed from polyolefins, their co-polymers, or polyamides, and may be monofilament or slit film type yarns. The top dressing comprises natural soil or a synthetic soil or may be a mix of natural soil or synthetic soil with conventional infill material, such as resilient particles, mineral particles coated with a resilient layer or other types of infill materials. Alternatively, the top dressing may include an absorbent material treated with a coloring agent. The filled fabric generally described above may be installed over a drainage system and can have an irrigation system, particularly for an indoor field, in order to simulate wet weather conditions, provide for more realistic game play and manage other aspects of the field.

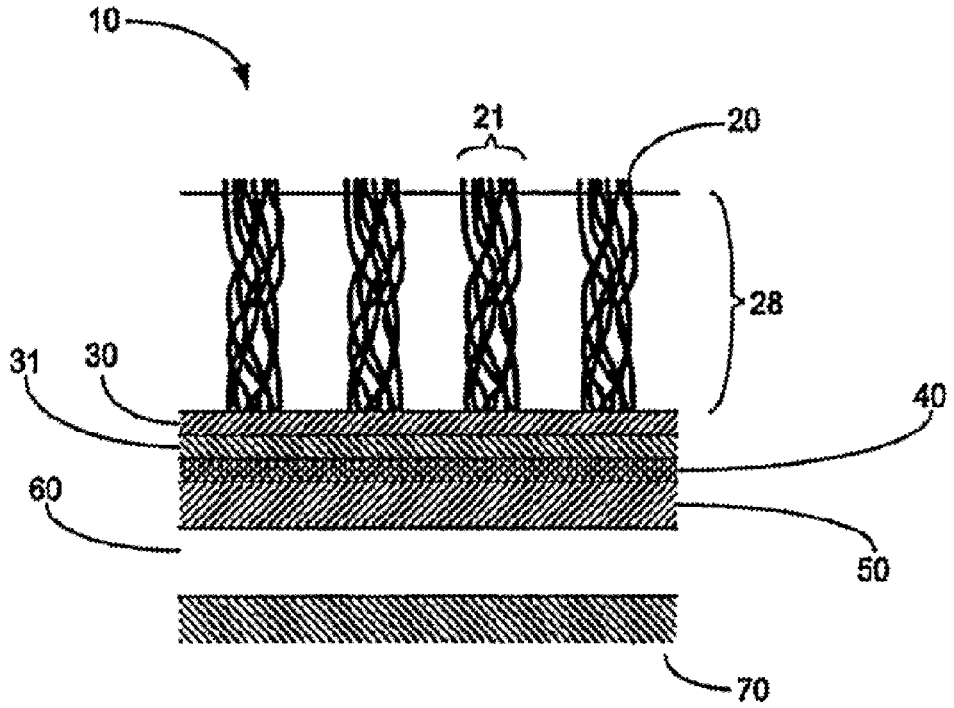

47 Claims, 3 Drawing Sheets